United States Patent [19]

Kötter et al.

[11] Patent Number: 4,499,744

[45] Date of Patent: Feb. 19, 1985

[54] DRY-CLEANING APPARATUS

[75] Inventors: Gustav Kötter; Peter Mutschlknaus, both of Melle, Fed. Rep. of Germany

[73] Assignee: Multimatic Maschinen GmbH & Co., Melle, Fed. Rep. of Germany

[21] Appl. No.: 508,465

[22] Filed: Jun. 28, 1983

[30] Foreign Application Priority Data

Jun. 28, 1982 [DE] Fed. Rep. of Germany ..... 3224043

[51] Int. Cl.[3] ..... D06F 39/00

[52] U.S. Cl. ..... 68/210

[58] Field of Search ..... 68/210, 19.2, 26; 34/236

[56] References Cited

U.S. PATENT DOCUMENTS 3,357,213 12/1967 Herbertz ..... 68/210

3,400,467 9/1968 Drace ..... 34/236 X 3,902,337 9/1975 Files ..... 68/210 X

*Primary Examiner*—Philip R. Coe

*Attorney, Agent, or Firm*—Fleit, Jacobson, Cohn & Price

[57] ABSTRACT

Dry-cleaning apparatus comprises washing and drying drum housings pivotably mounted in the frame of the apparatus about parallel axes extending transversely to the drums at the side of the base. The washing drum is so disposed above the drying drum that the axes of the drums are substantially in registry when swung through an acute angle. Between a discharge opening in the washing drum housing and an oppositely disposed filling opening in the drying drum housing, there are conveyor means which connect these two openings.

4 Claims, 4 Drawing Figures

DRY-CLEANING APPARATUS

The invention relates to a dry-cleaning apparatus comprising washing and drying drums having housings tiltably mounted in the frame.

Use is nowadays mostly made of dry-cleaning apparatuses which have only one drum. In such single drum machines, the washing step first takes place in the drum and, after completion thereof and extraction of the solvent, the drying step in which solvent adhering to the goods is vaporised and recovered by condensation. Single drum machines can be sensibly employed only when using solvents such as tetrachloroethylene and FKW 113 because these solvents have only a low heat of vaporisation and low evaporation index number. The filling ratio in such single drum machines is between 1:18 to 1:20, which means that for each kp of goods a drum volume of 18 to 20 l is available.

Since the output of such single drum machines is only low because no cleaning can take place during the drying step, machines have been proposed with an additional drying drum. In such machines, the textiles are washed or cleaned in the washing drum with a filling ratio of 1:10 to 1:12. At the end of the washing step, the goods are centrifugally predried and transferred to the drying drum. In the drying drum, the remainder of the solvent adhering to the textiles is evaporated and subsequently condensed in known manner. Loading and unloading of the cleaning and drying drums as well as transferring between the drums is effected manually. Operation of such machines is therefore not only expensive on labour but one must also provide suction-extracting means for the solvent vapours in order to keep the maximum concentration within prescribed limits at the place of work.

It is therefore the problem of the invention to provide a dry-cleaning apparatus of the aforementioned kind in which transfer of the textiles between the washing and drying drums is effected automatically.

According to the invention, this problem is solved in that the housings are pivotably mounted in the frame about parallel axes extending transversely to the drums at the side of the base and the washing drum is so disposed above the drying drum that the axes of the drums are substantially in registry when swung through an acute angle, and that between the discharge opening in the housing of the washing drum and the oppositely disposed filling opening in the housing of the drying drum there are conveyor means connecting the openings. In the dry-cleaning apparatus according to the invention, a washing step can take place whilst the previous contents of the washing drum are simultaneously dried in the drying drum. Since both steps take about the same time, the output can be doubled in comparison with single drum machines. Transfer of the goods following completion of the washing step into the drying drum which has in the meantime been emptied takes place in a simple manner by tilting the drum housings, conveyor means being introduced between the discharge and filling openings to bridge same.

In its tilted condition, the washing drum can also be automatically loaded in a simple manner. Similarly, it is possible to tilt the drying drum for automatic emptying so that the dried goods are for example discharged onto a conveyor belt or the like disposed in front of the discharge opening. The tilting of drum housings for the purpose of emptying the drums is known.

Desirably, the washing drum housing is oppositely pivotable about parallel spaced axes so that, for automatically filling and for automatically transferring the goods, the washing drum housing need only be provided with one closable opening.

Other advantageous embodiments of the invention have been described in the subsidiary claims.

One example of the invention will now be described in more detail with reference to the drawing, wherein.

Figure 1:
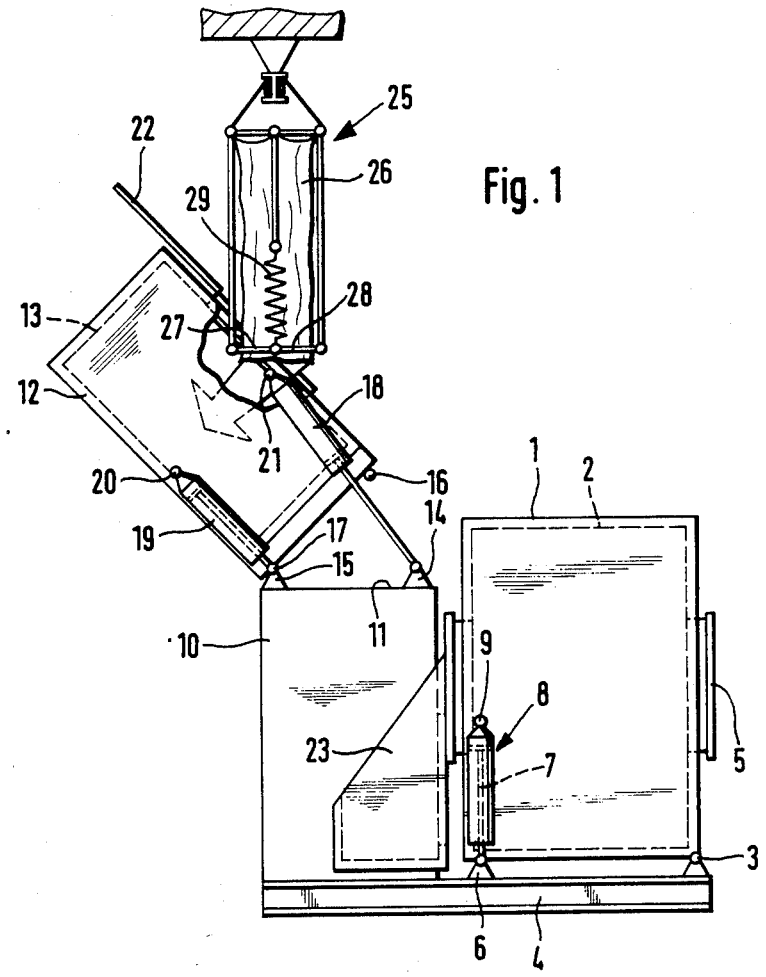
FIG. 1 is a diagrammatic side elevation of the dry-cleaning apparatus with its washing drum tilted to the loading position.

The housing 1 of the drying drum 2 is pivotably mounted on the base frame 4 of the frame about the pivot 3 which is disposed below the discharge door 5. On the side 3 opposite the pivot, the housing 1 is supported on a pedestal 6 secured to the base frame 4. To the pedestal 6 there is hinged the piston rod 7 of the piston-cylinder unit 8 of which the cylinder is hinged to the housing 1 at the point 9. By means of the piston-cylinder unit 8, the drying drum 2 can be tilted about the pivot 3 for the purpose of discharge and transfer. In the operative positions shown in FIGS. 1 and 2, the piston-cylinder unit 8 pulls the housing 1 of the drying drum 2 onto the pedestal 6 of the base frame 4 so that it is fixed within the frame.

A supporting frame member 10 is connected to the base frame 4 and on its elevated surface 11 the housing 12 of the washing drum 13 is mounted. Pedestals 14, 15 secured to beams or plates forming the elevated surface 11 are provided with recesses for supporting bearing pins 16, 17 disposed on the underside of the housing. The piston rods of two piston-cylinder units 18, 19 are pivotably mounted to the pedestals 14, 15, their pivot axes being in registry with the bearing pins 16, 17 of housing 12 in the operative position of the washing drum shown in FIG. 2. The cylinders of the piston-cylinder units 18, 19 are hinged to the housing 12 at the points 20, 21 shown in FIG. 1.

At the side facing the drying drum 2, the washing drum housing 12 is provided with a door 22 for filling and transfer.

Figure 4:
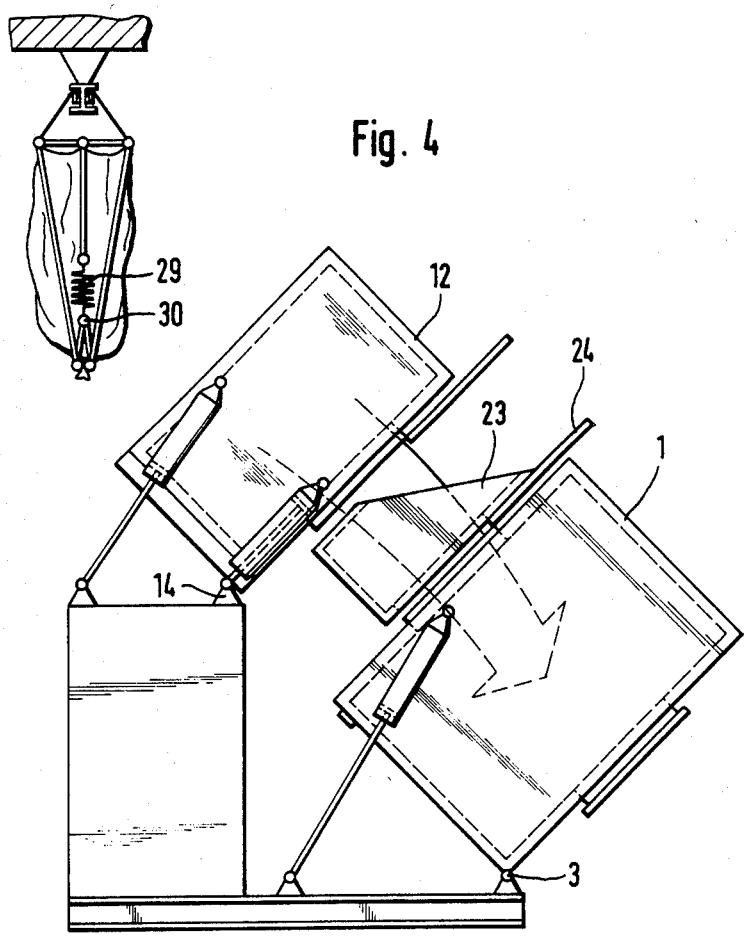
FIG. 4 is a diagrammtic representation of the dry-cleaning apparatus with its washing and drying drums tilted to their transfer positions.

A slide 23 connected to the drying drum housing 1 can be moved from its retracted position of readiness shown in FIG. 1 to its FIG. 4 operative position between the drums which are swung to their transfer position. For transfer, the loading door 24 of housing 1 is opened.

To load the dry-cleaning apparatus, the washing drum housing is first swung to the left in the manner shown in FIG. 1 about the pivot pin 17 by the piston-cylinder unit 18 and the door 22 is opened. The goods to be cleaned are supplied by a suspended carriage 25 running in a ceiling track in a manner such that the lower discharge opening of the transporting containers 26 is disposed above the filling opening of the washing drum 13. The transporting containers 26 consist of sacks which are open at the top and bottom and can be closed by clamping means at their lower end. It is only at the instant of discharging into the washing drum 13 that the clamping means are opened by mechanical spreading apparatus which, for example, be operated by a compressed air cylinder. Loading of the washing drum 13 can be performed automatically through the base opening of the transport container.

The opening means of the transport container 13 consist of the pivotally interconnected rods 27, 28 which are, for example, moved to their closing position of FIG. 4 by a tension spring 29. To open the transport container, the common hinge 30 of rods 27, 28 is moved downwardly by a hydraulic cylinder. Following automatic opening of the transport container 26, the textiles drop out into the washing drum 13 which is rotated at a higher speed. This increase in rotary speed during the filling step is necessary to gain sufficient free space near the middle of the drum into which the goods can drop. Otherwise, a pile would form in the middle of the drum and the goods could no longer be received by the drum. After loading of the cleaning drum 13, the loading door 22 is automatically closed by suitable means (not shown). The piston-cylinder unit 18 thereupon swings the washing drum housing to the operative position shown in FIG. 2.

Figure 2:
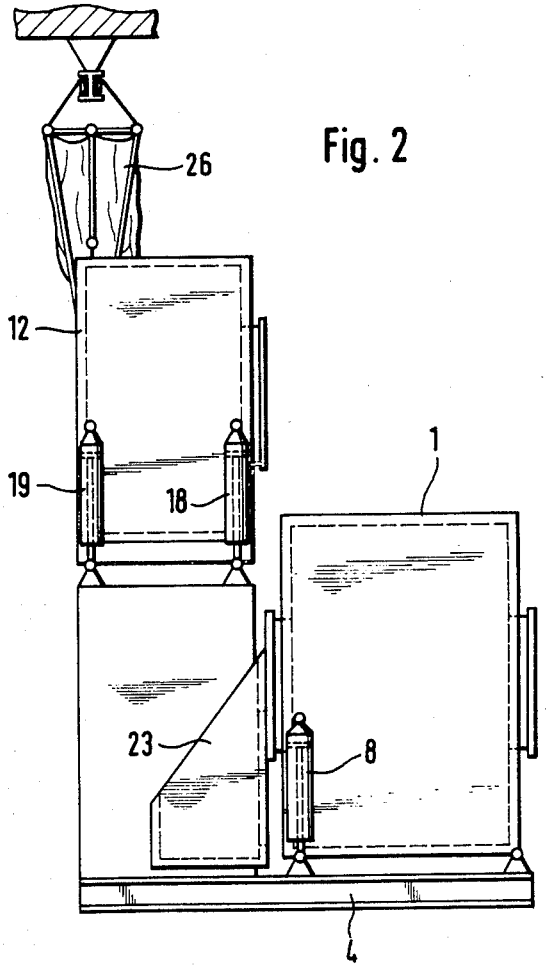
FIG. 2 is a diagrammatic side elevation of the dry-cleaning apparatus of FIG. 1 with the washing and drying drums in their operative positions.

The washing drum housing 12 and the drying drum housing 1 are shown in their operative positions in FIG. 2. Whilst the loaded textiles are cleaned in the washing drum 13, the goods that had been cleaned in the preceding washing step are dried in the drying drum 2. Additional storage containers 26 with textiles to be cleaned are already located on the suspended carriage in a position of readiness.

In the FIG. 2 operative position, the piston-cylinder units 18, 19 hold the washing drum housing tightly onto the upper frame plates or beams whereas the drying drum housing 1 is fixed to the base frame 4 by the piston-cylinder unit 8.

Figure 3:
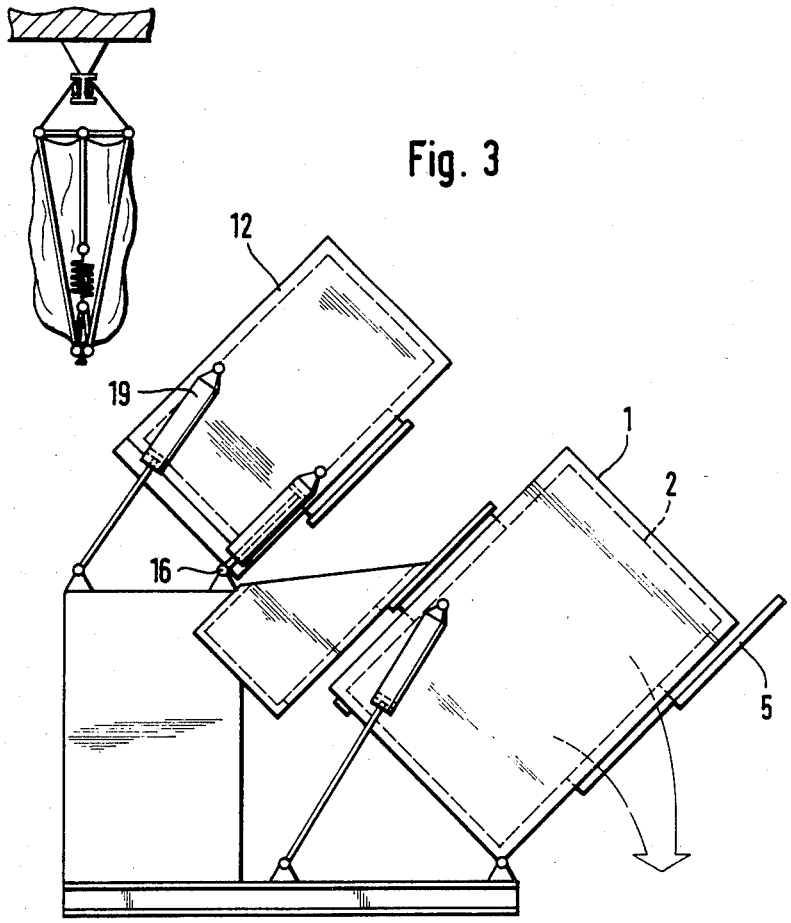
FIG. 3 is a diagrammatic side elevation of the dry-cleaning apparatus with its drying drum tilted to its emptying position.

At the end of the drying step, the drying drum 2 is emptied after tilting of the drying drum housing 1 in the manner shown in FIG. 3 and after opening of the discharge door 5, the cleaned goods desirably dropping onto a transport belt (not shown) which takes them away automatically. It is also possible to position receptacles below the discharge opening of the drying drum housing 1.

Since the cleaning time is substantially equal to the drying time, the drying drum 13 is already swung into its FIGS. 3 and 4 transfer position during emptying of the drying drum 2. For this purpose, the piston-cylinder unit 19 tilts the washing drum housing 13 about the pivot pin 16. During tilting, the hydraulic cylinder 18 retains the bearing pin 16 in its pivot bearing. The pivot bearing can be a roller bearing instead of a bearing pin.

After the emptying step and reclosing the discharge door 5, the loading door 24 of the drying drum housing and the door 22 of the washing drum housing are opened. The slide 23 is simultaneously moved to its operative position so that transfer can commence. Desirably, the slide 23 is connected to the loading door 24 so that the latter takes the slide with it as it is opened.

During filling of the drying drum 2, the latter turns at increased speed so that the textiles can lie against the drum periphery immediately upon entering and the central region of the drum remains free for filling. The washing drum turns at the cleaning speed and conveys the textiles upwardly and forwardly by reason of its oblique position so that the textiles reach the drying drum by way of the slide 23.

Subsequently, the drying drum housing 1 is swung to its operative position and the washing drum housing 12 to its FIG. 1 filling position. The steps are thereupon repeated in an analogous manner.

All loading, transfer and discharge steps can be carried out automatically so that the operating personnel is spared unpleasant work and the output can be increased.

We claim:

1. A dry-cleaning apparatus comprising:

frame means, a drying housing pivotably mounted on the frame means, a drying drum mounted in the drying housing, a washing housing pivotably mounted on the frame means above the drying housing, a washing drum mounted in the washing housing, the drying housing and washing housing being pivotable about parallel axes extending transversely to an axis of the drying drum and an axis of the washing drum, the washing drum being positioned above the drying drum so that the axis of the washing drum and the axis of the drying drum are substantially aligned after both housings have been pivoted from the frame means through an acute angle, the drying housing defining a loading opening for loading the drying drum, a door for closing the loading opening, the washing housing being oppositely pivotable about a second axis parallel and spaced from its first mentioned axis to pivot between a loading position and a discharge position, the washing housing defining an opening for use in filling the washing drum when the washing housing is pivoted in one direction to the loading position and for use in emptying the washing drum when the washing housing is pivoted in the opposite direction to the discharge position, a door for closing the washing drum opening, a conveying means communicating with the loading opening of the drying housing when the washing housing is pivoted to the discharge position to effect the said alignment of the axes of the washing and drying drums, the drying housing defining a discharge opening for discharging the drying drum, a door for closing the discharge opening, the discharge opening being located opposite to the loading opening of the dryer housing, two piston-cylinder units for pivoting the washing housing to the loading position and the discharge position, each unit being pivotably connected at one end to the washing housing and pivotably connected at the other end to the frame means, the ends connected to the frame means being spaced from each other and form pivotable points through which the parallel spaced pivot axes of the washing housing extend, and a piston-cylinder unit for pivoting the drying housing being pivotably connected at one end to the drying housing and pivotably connected at the other end to the frame means to pivot the drying housing for filling and discharge of the drying drum.

2. A dry-cleaning apparatus as defined in claim 1, wherein the conveyor means comprises a slide displaceably mounted on the loading opening side of the drying housing.

3. A dry-cleaning apparatus as defined in claim 2, wherein the slide is movable in unison with the door of the loading opening of the drying housing.

4. A dry-cleaning apparatus as defined in claim 1, wherein a displacement means is positioned beneath the discharge opening of the drying housing.

* * * * *